US005771863A

United States Patent [19]

Daly

[11] Patent Number: 5,771,863

[45] Date of Patent: Jun. 30, 1998

[54] INTEGRATED INTAKE MANIFOLD AND FUEL RAIL WITH ENCLOSED FUEL FILTER

[75] Inventor: Paul Desmond Daly, Troy, Mich.

[73] Assignee: Siemens Electric Limited, Tilbury, Canada

[21] Appl. No.: 730,528

[22] Filed: Oct. 11, 1996

[51] Int. Cl.[6] ..... F02M 55/02

[52] U.S. Cl. ..... 123/456; 123/470; 123/184.61

[58] Field of Search ..... 123/456, 468, 123/469, 470, 472, 184.31, 184.38, 184.61

[56] References Cited

U.S. PATENT DOCUMENTS

| | | | |
|---|---|---|---|
| 4,416,238 | 11/1983 | Knapp | 123/470 |
| 4,563,984 | 1/1986 | Ziegler et al. | 123/470 |
| 4,776,313 | 10/1988 | Freismuth | 123/470 |
| 4,909,221 | 3/1990 | Heuser | 123/470 |
| 5,080,069 | 1/1992 | Hudson, Jr. | 123/470 |
| 5,261,375 | 11/1993 | Rush, II et al. | 123/456 |
| 5,357,931 | 10/1994 | Semence | 123/184.61 |
| 5,394,850 | 3/1995 | Murphy et al. | 123/470 |
| 5,477,819 | 12/1995 | Kopec | 123/184.61 |
| 5,568,798 | 10/1996 | Lorraine | 123/456 |
| 5,611,313 | 3/1997 | Ashcraft | 123/456 |

*Primary Examiner*—Thomas N. Moulis
*Attorney, Agent, or Firm*—Russell C. Wells

[57] ABSTRACT

An integrated intake manifold-fuel rail construction with a separately molded trough-shaped fuel rail component friction welded to a runner spanning mounting plate molded as a part of the manifold. A filter is installed within the fuel rail component to intercept particles generated by the friction welding process to prevent their entry into the fuel injectors, each having one end installed in one of a series of sockets formed in the fuel rail component.

6 Claims, 4 Drawing Sheets

INTEGRATED INTAKE MANIFOLD AND FUEL RAIL WITH ENCLOSED FUEL FILTER

BACKGROUND OF THE INVENTION

This invention concerns fuel rails for internal combustion engines which communicate pressurized fuel to the inlet of fuel injectors and are operated to periodically inject a spray of fuel into the intake port of each engine cylinder. Fuel rails typically comprise metal tubes extending along the cylinder head of the engine, with one end of each injector received in a respective seat or socket formed in the fuel rail, the other end of each injector received in a respective port in the intake manifold (or sometimes in the cylinder head itself). Fuel under pressure in the fuel rail is communicated to each injector so that when the engine controls open a particular injector valve, fuel is sprayed into the engine intake port with which the particular injector is associated.

In such typical designs, the fuel rail is mounted by means of separate bracketing.

In recent years, intake manifolds have begun to be constructed of molded plastic in order to reduce weight and lower costs and eliminate the separate brackets.

It has heretofore been proposed to mold the fuel rails as a part of the intake manifold to reduce assembly costs.

See for example, U.S. Pat. No. 5,394,850 issued on Mar. 7, 1995 for a "Top-Feed Fuel Injector Mounting an Integrated Air-Fuel System".

The addition of an integral fuel rail to a molded intake manifold increases the complexity of the mold and may result in significant part scrappage due to defects in the fuel rail portion, which is not cost effective since the entire manifold must be scrapped if a defect occurs in the fuel rail portion, a much larger and more expensive component than the fuel rail itself.

Accordingly, it is an object of the present invention to provide an integrated intake manifold fuel rail construction in which the fuel rail and intake manifold are not molded as s single structure.

SUMMARY OF THE INVENTION

The above object is achieved by separately molding a trough-shaped fuel rail component having a surrounding friction welded flange. The intake manifold is molded with a series of supporting gussets, each projecting from a respective manifold runner, the gussets spanned by a mounting plate molded integrally with the gussets. A filter strip is installed within the fuel rail component lying over a series of tubular injector sockets projecting from the underside of the fuel rail component. The fuel rail component is then friction-welded to the mounting plate to complete the integrated intake manifold-fuel rail construction. Alternatively, a series of individual filters can be used, each disposed in a respective injector socket.

The filter captures any friction weld flash materials which may become dislodged and enter the fuel stream, preventing flash weld debris from entering the fuel injectors themselves.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
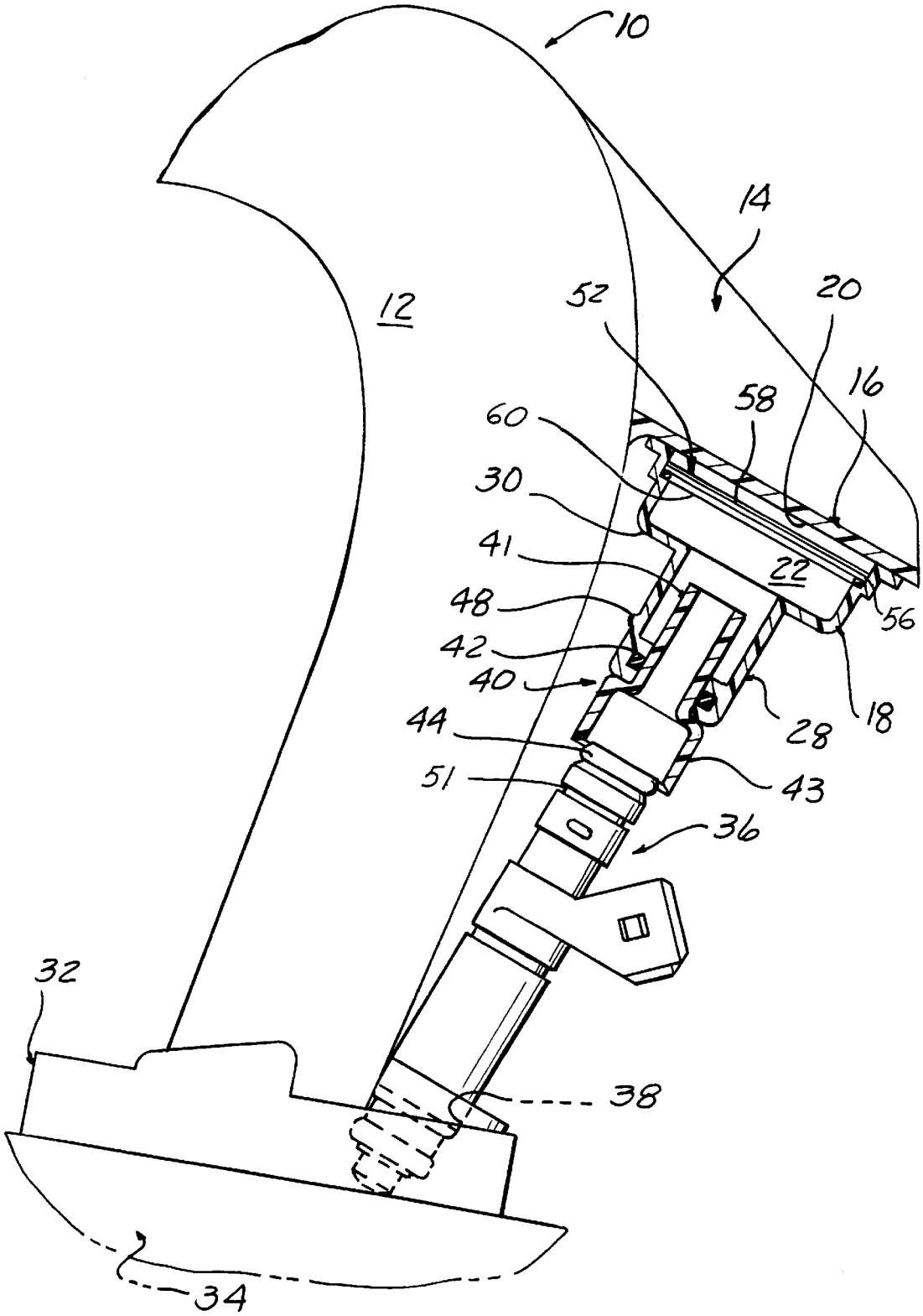
FIG. 1 is a fragmentary partially sectional end view of an integrated intake manifold-fuel rail according to the present invention, showing an injector in position to be installed with a connector tube in a retracted position.
Figure 3:
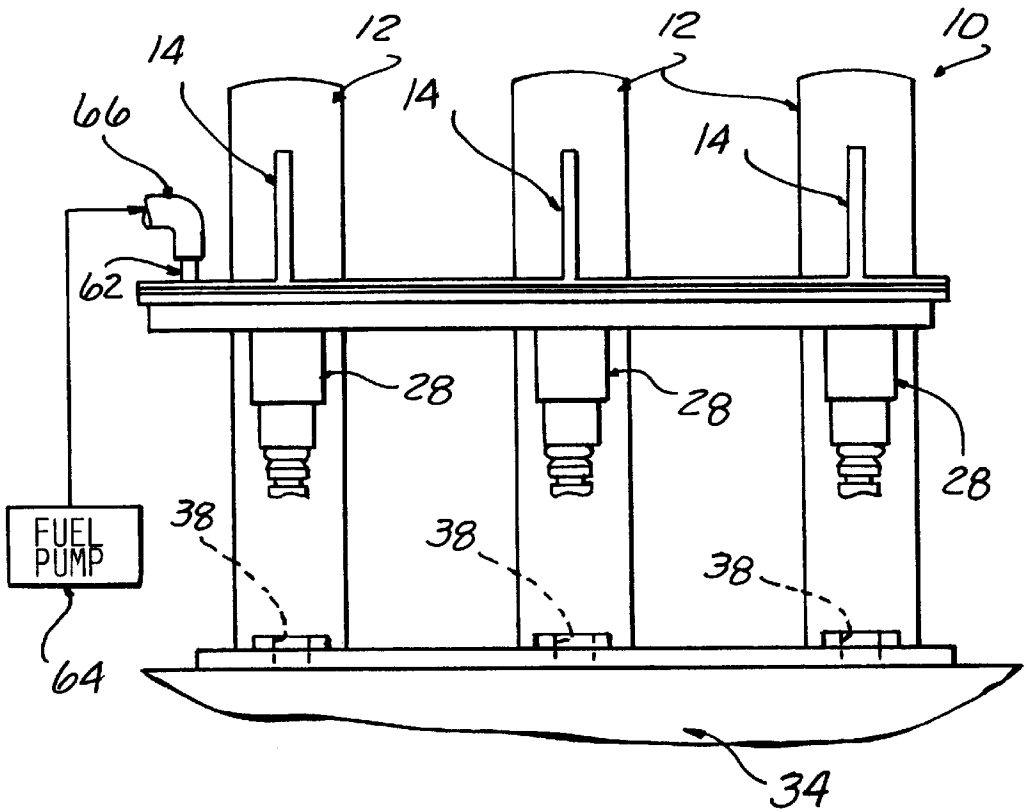
FIG. 3 is a fragmentary side view of the integrated intake manifold-fuel rail according to the present invention, with a diagrammatic representation of a fuel supply connection.

Referring to FIGS. 1 and 3, according to the present invention each runner 12 of a molded intake manifold 10 is formed with a series of parallel, integral support gussets 14, the gussets 14 spanned by a connected mounting plate 16, integrally molded as a part of the gussets 14. The intake manifold 10 may be molded from a glass-filled amide or polyamide plastic in a conventional manner.

An elongated trough-shaped fuel rail component 18 is separately molded, and is subsequently friction welded to the undersurface 20 of the mounting plate 16 to form an enclosed fuel space 22 extending along the runners 12.

Figure 2:
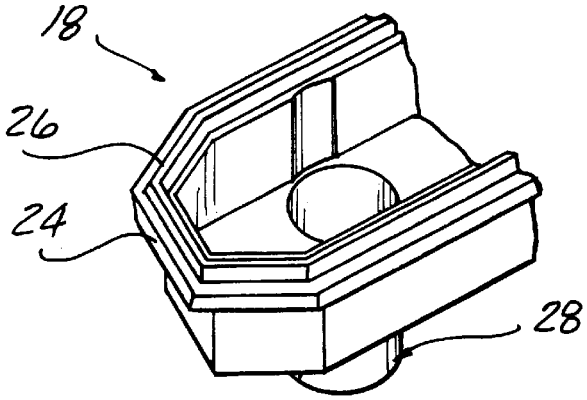
FIG. 2 is a fragmentary perspective view of a fuel rail component prior to being friction-welded to the molded intake manifold.

The fuel rail component 18 has an out-turned flange 24 FIG. 2 defining a planar surface with a friction welding ridge 26 extending around the perimeter of the flange 24.

During friction welding, the ridge 26 is positioned against the undersurface 20 of the mounting plate 16, and rapidly oscillated, as with an ultrasonic drive, causing heat to be generated at the contacting area sufficient to fuse the plastic material of the ridge 26 to melt and fuse with plastic material of the manifold. Upon cooling, an integral intake manifold-fuel rail part results.

Further details of the friction welding process and equipment are not here disclosed, inasmuch as this process is well known to those skilled in the art.

A series of tubular projections 28 extend from the bottom wall 30 of the fuel rail component 1 8, communicating with the interior fuel space 22.

The tubular projections 28 which comprise injector sockets are directed toward the upper side of a mounting flange 32 formed integral with the end of each runner 12, flange 32 adapted to be mounted to an engine cylinder head 34 in the conventional fashion.

Figure 1C:
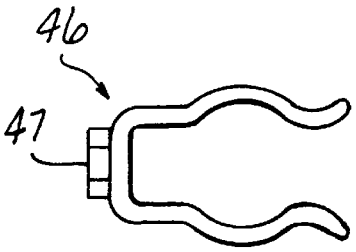
FIG. 1C is a plan view of the retention clip shown in FIG. 1B.
Figure 1B:
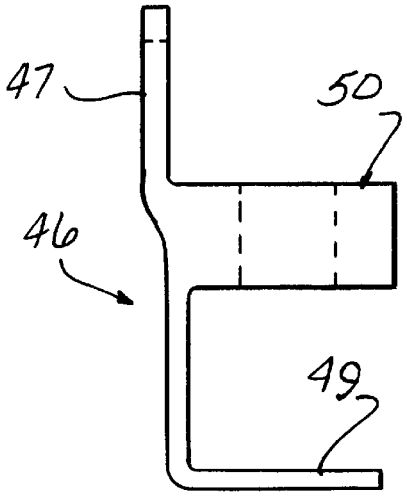
FIG. 1B is a side elevational view of the retention clip used to retain an injector connector tube.
Figure 1A:
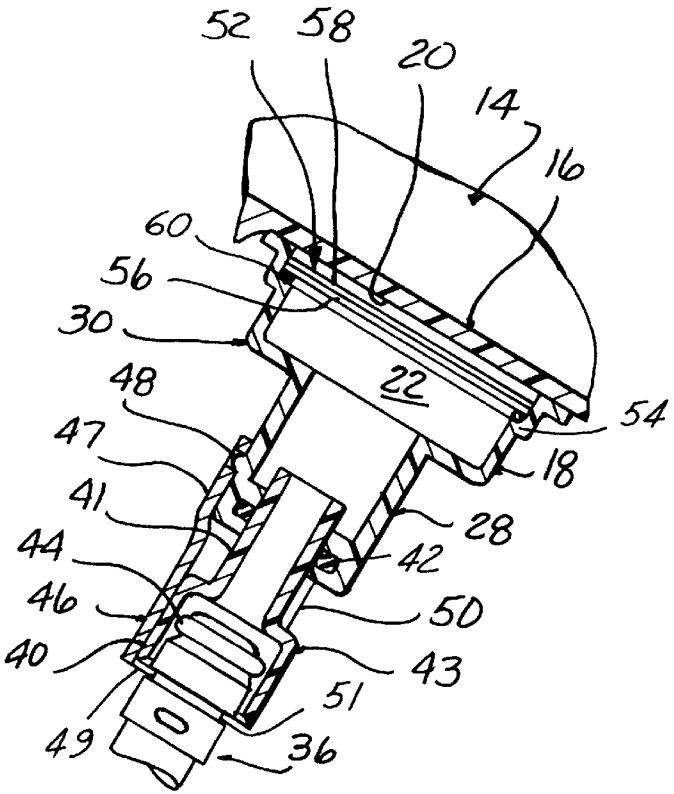
FIG. 1A shows the integrated intake manifold shown in FIG. 1, with the installation of an injector completed, filter installed, and a retention clip assembled onto the injector.

A fuel injector 36 is positioned with one end received in a respective one of a series of fuel injector ports 38 formed in a manifold mounting flange 32. The other end is positioned in alignment with a telescoping connector tube 40 retracted into the tubular projection 28. The connector tube 40 has an upper, smaller diameter end 41 sealed with an O-ring 42 and, as shown in FIG. 1A, has a larger diameter end 43 subsequently extended over the upper end of its associated injector 36 sealed with an O-ring 44 on the injector.

A retention element 46 or clip is then installed having an upper end 47 engaging molded projections 48 and an in-turned lower end 49 engaging a reduced diameter portion 51 of the injector 36, as well as the connector tube 40 by a clip portion 50 of the retention element 46 grasping the upper section of the reduced diameter portion 41 (see FIGS. 1B, 1C) of the connector tube 40.

This arrangement is described in detail in U.S. Pat. No. 5,394,850 identified above, which is incorporated by reference herein.

Prior to friction welding of the fuel rail component 18, a screen filter strip 52 is installed extending across the bottom of the fuel rail component 18, held as in a stepped feature or shoulder 54 molded therein. The filter 52 may be of a two-layer construction with a large mesh supporting screen layer 56 underlying a fine mesh filtering layer 58 in the well known manner.

A seal 60 is also provided to prevent any bypass flow of fuel around the filter 52.

The purpose of the filter 52 is to intercept any material generated as "flash" from the friction welding process which may come loose from entering any of the injectors 36, preventing entry into the injector and thereby avoiding any clogging associated with each injector.

The filter 52 is of much greater area than the internal filter which may be in each injector, such that servicing should not be required. The filter 52 will be permanently retained within the fuel space 22 of the fuel rail once friction welding of the fuel rail component 18 to the mounting plate 16 has been carried out. The filtering area is maximized by the spacing above the bottom wall afforded by the shoulder or strap 54.

As illustrated in FIG. 3, the fuel space 22 may be supplied with fuel under pressure by means of an integral hose fitting 62, communicating with the fuel pump 64 via line 66. The fuel should of course be introduced upstream of the filter 52.

Figure 4:
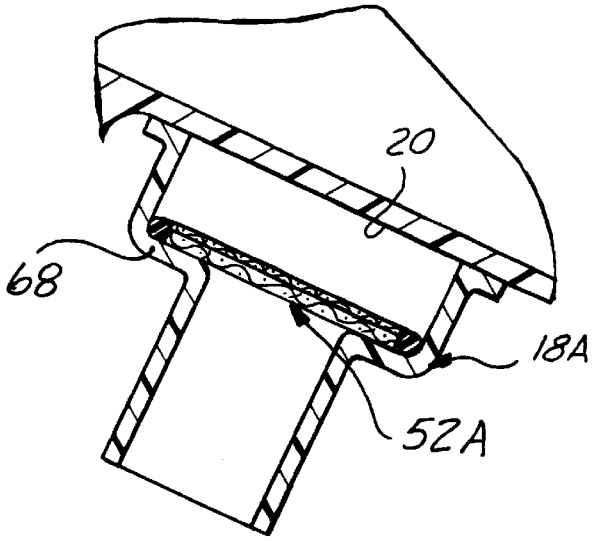
FIG. 4 is a sectional view through the fuel rail component showing an alternative filter arrangement.

If maximum filter area is not required, a radially sealed filter 52A may be employed (FIG. 4) positioned directly against the bottom wall 68 of a straight-sided fuel rail component 18A.

Figure 5:
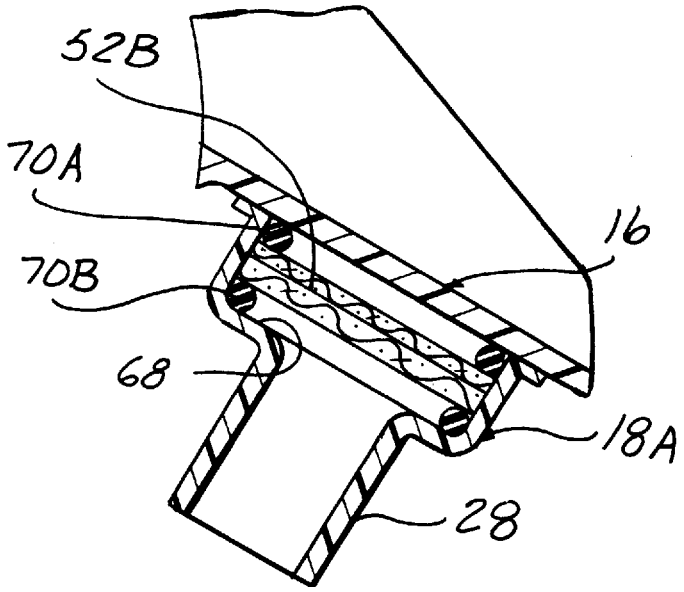
FIG. 5 is a sectional view through the fuel rail component showing yet another filter arrangement.

The filter 52B can also be installed using a pair of axial seals 70A, 70B, spacing the filter 52B above the bottom wall 68 (FIG. 5).

Figure 6:
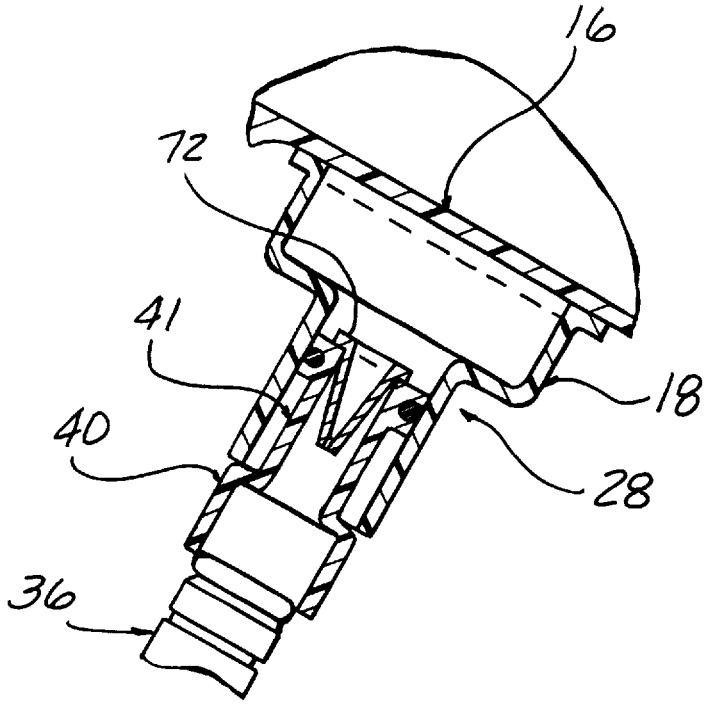
FIG. 6 is a sectional view through the fuel rail component showing still another filter arrangement.

Individual external filters for each injector 36 can also be employed as seen in FIG. 6. An inverted conical filter 72 can be installed in the small diameter portion 41 of each connector tube 40. This also allows servicing the filter 72, as it can be removed when the injectors 36 are removed. Thus, the filter area is not as critical.

Accordingly, an integrated molded intake manifold and fuel rail can be constructed without the need to mold both components as a single piece at the same time, so that each component is easier to mold, and a flaw in the fuel rail will not necessitate scrapping of a manifold.

I claim:

1. An integrated intake manifold and fuel rail, comprising:

a molded plastic intake manifold including a series of air induction runners and a mounting flange integral with one end of said runners;

a fuel rail component spanning said air induction runners and fixed thereto, said fuel rail component defining an enclosed space, with a series of tubular fuel injector sockets entering into said enclosed space;

a filter screen strip extending along the inside of said fuel rail and across said each of said sockets to prevent any debris from passing out through said sockets and a seal for sealing the perimeter of said screen strip along the inside of said fuel rail against flow thereby.

2. The integrated intake manifold and fuel rail according to claim 1 wherein said intake manifold includes a mounting plate integral with said runners, said fuel rail component comprising a trough-shaped structure having an open side thereof permanently attached to said mounting plate to define said enclosed space, said filter screen strip permanently installed within said space.

3. The integrated intake manifold and fuel rail according to claim 1 wherein said fuel rail component is trough-shaped with a step in side and end walls thereof, extending around a perimeter of said component, said filter strip and said seal being disposed within said step feature.

4. The integrated intake manifold and fuel rail according to claim 1 wherein said seal is interposed between said filter screen strip and bottom wall of said fuel rail component to space said filter screen strip above said bottom wall.

5. The integrated intake manifold and fuel rail according to claim 1 wherein said seal is a radial seal extending around the perimeter of said filter screen strip and against an inner perimeter wall of said fuel rail component.

6. An integrated intake manifold and fuel rail comprising the steps of:

molding an intake manifold with a series of air induction runners, with each runner having a gusset projecting away therefrom and a mounting plate spanning across said gussets and integral therewith;

separately molding an elongated trough-shaped fuel rail component having a bottom wall opposite an open side with a flange extending around said open side of said fuel rail perimeter and with a series of fuel injector sockets extending from said bottom wall distributed along the length of said fuel rail component;

installing a seal interposed said open side and said bottom wall:

installing filter screen strip in said fuel rail component on said seal and interposed said seal and said open side, said filter screen strip extending across each of said injector sockets; and friction welding said fuel rail component flange to said mounting plate to define a fuel space within said fuel rail component and enclosing said filter screen strip and said seal.

* * * * *